US008083364B2

(12) United States Patent
Allen

(10) Patent No.: US 8,083,364 B2
(45) Date of Patent: Dec. 27, 2011

(54) REMOTE PHOSPHOR LED ILLUMINATION SYSTEM

(75) Inventor: Steven C. Allen, Beverly, MA (US)

(73) Assignee: Osram Sylvania Inc., Danvers, MA (US)

( * ) Notice: Subject to any disclaimer, the term of this patent is extended or adjusted under 35 U.S.C. 154(b) by 171 days.

(21) Appl. No.: 12/345,172

(22) Filed: Dec. 29, 2008

(65) Prior Publication Data

US 2010/0165599 A1 Jul. 1, 2010

(51) Int. Cl.
*F21V 9/16* (2006.01)

(52) U.S. Cl. ..... 362/84; 362/311.02; 362/296.01

(58) Field of Classification Search ..... 362/84, 362/311.02, 296.01, 300
See application file for complete search history.

(56) References Cited

U.S. PATENT DOCUMENTS

| | | | | |
|---|---|---|---|---|
| 6,048,616 | A | 4/2000 | Gallagher et al. | |
| 6,207,229 | B1 | 3/2001 | Bawendi et al. | |
| 6,366,033 | B1 | 4/2002 | Greci et al. | |
| 7,293,908 | B2 | 11/2007 | Beeson et al. | |
| 7,810,956 | B2 * | 10/2010 | Bierhuizen et al. | 362/294 |
| 2006/0034084 | A1 * | 2/2006 | Matsuura et al. | 362/293 |
| 2007/0267976 | A1 | 11/2007 | Bohler et al. | |
| 2008/0030993 | A1 | 2/2008 | Narendran et al. | |
| 2008/0054281 | A1 | 3/2008 | Narendran et al. | |
| 2008/0117500 | A1 * | 5/2008 | Narendran et al. | 359/326 |
| 2009/0050908 | A1 * | 2/2009 | Yuan et al. | 257/88 |

FOREIGN PATENT DOCUMENTS

| | | | |
|---|---|---|---|
| EP | 1691425 | A1 | 8/2006 |
| WO | 2005107420 | A2 | 11/2005 |
| WO | WO2007/107420 | | 11/2005 |
| WO | 2008060335 | A1 | 5/2008 |
| WO | 2009024952 | A2 | 2/2009 |

OTHER PUBLICATIONS

European Search Report and Annex for corresponding European Patent Application 09178492.6, mailed Apr. 13, 2010, Applicant: Osram Sylvania Inc.

* cited by examiner

*Primary Examiner* — Evan Dzierzynski
(74) *Attorney, Agent, or Firm* — Shaun P. Montana

(57) ABSTRACT

An illuminator is disclosed, in which an LED module emits short-wavelength light toward a phosphor module, which absorbs it and emits wavelength-conditioned light. The emission is generally longitudinal, with a generally Lambertian distribution about the longitudinal direction. The phosphor module includes a transparent layer, closest to the LED module, and a phosphor layer directly adjacent to the transparent layer. Both layers are oriented generally perpendicular to the longitudinal direction. The illuminator includes a reflector, circumferentially surrounding the emission plane in the LED module and extending longitudinally between the emission plane and the transparent layer. Virtually all the light emitted from the LED module either enters the phosphor module directly, or enters after a reflection off the reflector. The transverse side or sides of the transparent layer support total internal reflection, so that virtually all the light that enters the transparent layer, from the LED module, is transmitted to the phosphor layer. In some applications, the phosphor layer is located at the focus of a concave mirror, which can narrow and/or collimate the light emitted by the phosphor. Adjacent to the phosphor layer and opposite the transparent layer, the phosphor module can include a transparent dome, a heat sink, or nothing.

17 Claims, 7 Drawing Sheets

REMOTE PHOSPHOR LED ILLUMINATION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is directed to an LED-based phosphor illuminator.

2. Description of the Related Art

Light emitting diodes (LEDs) are rapidly finding acceptance in many lighting applications. Compared with incandescent light bulbs, LEDs are more efficient, have longer lifetimes, and may be packaged in a wide variety of suitably shaped and sized packages.

In particular, so-called white-light LEDs are become more popular for illumination applications. In these white-light LEDs, the light-producing element is typically an LED that emits light at a relatively short wavelength, such as blue, violet, or UV. The light emitted from the so-called blue LED strikes a phosphor. The phosphor absorbs the blue light and emits light at one or more longer wavelengths, which may include discrete wavelengths in addition to continuous portions of the spectrum. The light emitted from the phosphor may be used to illuminate an object, or may be used for general lighting purposes.

Many of the characteristics that pertain to human vision, such as the (x,y) coordinates on the CIE color chart (or other suitable chart), and the so-called color temperature (which relates the emission spectrum of the phosphor to that of a blackbody having a particular temperature), are typically determined by the chemical properties of the phosphor itself, its interaction with the illuminating blue light, and the wavelength of the illuminating blue light.

There are additional factors that affect the performance of an LED-based illuminator, which are generally independent of the performance of the phosphor. For instance, a dominant contributor is typically the efficiency of getting phosphor-emitted/scattered light out of the device. A secondary contributor is typically the efficiency of the optical path between the blue LED and the phosphor helps determine the brightness of the illuminator. In other words, the higher the percentage of photons leaving the blue LED and striking the phosphor, the more output light emitted by the phosphor. In addition, many phosphors emit light in a Lambertian manner, with a similar or identical angular profile. For some applications, this Lambertian distribution may be too wide, and a narrower cone of light may be desired.

In general, the known optical systems fail to provide an LED-based illuminator that has both a high fixture efficiency (i.e., a high percentage of light leaving the blue LED that strikes the phosphor) and a relatively narrow beam angle (i.e., a relatively small angular distribution of exiting light, compared to a Lambertian distribution).

As specific examples, we consider three known references, and we note their deficiencies below.

As a first example, we consider United States Patent Application Publication No. US 2007/0267976 A1, titled "LED-based light bulb", invented by Christopher L. Bohler, et al., and published on Nov. 22, 2007. FIG. 5 from Bohler is reproduced herein as FIG. 1 in the present application.

The lighting system 510 of Bohler includes a wavelength converting material such as organic or inorganic phosphor. The phosphor can be located in any suitable location, such as integrated into the LED 512, at a light guide 536, coated inside or outside the cover 522, contained within the cover 522, or a combination thereof. Examples of the organic transparent phosphors are the BASF Lumogen F dyes such as Lumogen F Yellow 083, Lumogen F Orange 240, Lumogen F Red 300, and Lumogen F Violet 570. Of course, it is also contemplated that other phosphors such as the rare earth complexes with organic component described in the U.S. Pat. No. 6,366,033; quantum dot phosphors described in the U.S. Pat. No. 6,207,229; nanophosphors described in the U.S. Pat. No. 6,048,616, or other suitable phosphors can be used.

The UV light rays 540 are emitted by the LEDs 512 and converted into white or visible light 542 by a phosphor 544. The phosphor 544 preferably includes two or more phosphors to convert the emitted light 540 to the visible light 542, although single component phosphors are embodied for saturated color light generation as well. The visible light 542 exits through the enclosure 522. In this embodiment, the phosphor mix 544 is disposed about or within a light guide 536 which is a planar panel disposed above the LED 512 such that the majority of the light rays 540 strike the panel.

Two issues are notable with the device 510 of Bohler.

First, a relatively small fraction of the light emitted from the LEDs 512 reaches the phosphor 544. The phosphor itself has a particular size and is located a particular distance away from the LEDs 512. Light emitted from the LEDs 512 has a particular angular distribution, typically a Lambertian distribution, such that a certain percentage of LED light strikes the phosphor 544, with the remaining light missing the phosphor and failing to generate any white light. This results in a reduced efficiency in the fraction of LED emission that is delivered to the phosphor, which may be significantly less than 100%.

Second, the light exiting the phosphor 544 leaves the phosphor plane and travels directly out to the viewer. In general, light emitted from a planar phosphor has a relatively wide angular distribution, which may be considered too wide for some applications. A more detailed explanation of this emission from a plane is provided in the following paragraph.

In general, light emitted from a phosphor is found to have a generally Lambertian distribution in power per angle. A Lambertian distribution has a peak that is oriented normal to the emitting surface (often denoted as 0 degrees), with an angular falloff of $\cos\theta$, where $\theta$ is with respect to the surface normal. This Lambertian distribution may be represented numerically by a full-width-at-half-maximum (FWHM) in angle, given by $2\cos^{-1}(0.5)$, or 120 degrees. For many applications, this FWHM of 120 degrees may be considered relatively wide. There may be instances when a more narrow or a more controllable beam is desired.

As a second example, we consider United States Patent Application Publication No. US 2008/0030993 A1, titled "High efficiency light source using solid-state emitter and down-conversion material", invented by Nadarajah Narendran, et al., and published on Feb. 7, 2008. The '993 publication was originally published on Nov. 17, 2005 as PCT Application Publication No. WO2005/107420 with informal figures. FIG. 4 from Narendran is reproduced herein as FIG. 2 in the present application.

The embodiment in FIG. 2 may be used in interior spaces where general ambient lighting is required. As shown, the device includes phosphor plate 650 (for example YAG:Ce or other phosphors). The device also includes multiple semiconductor light emitting diodes 656 forming an array, such as LED/RCLED array 652. The array 652 is mounted on substrate 654 that may be of aluminum material. In an exemplary embodiment, substrate 654 may be circular. In the exemplary configuration illustrated in FIG. 2, the LEDs/RCLEDs are arranged in a spaced relation to each other and placed around the circular substrate.

In Narendran, the array of light emitting diodes are placed on the substrate so that the light emitting surfaces of the diodes face toward phosphor layer plate 650. In this manner, diodes 656 emit short wavelength light toward phosphor layer plate 650. As the short wavelength light impinges on the phosphor layer plate, four components of light results: reflected short wavelength light and down-converted light 660 and transmitted short wavelength light and transmitted down converted light 664. The short wavelength light and down converted light 660 is reflected, as shown, within the device to produce white light 662. The transmitted short wavelength light and down-converted light 664 is transmitted outside of the device to produce white light 66.

The device of Narendran has the same two issues as that of Bohler. First, the fraction of LED emission that is delivered to the phosphor may be significantly less than 100%. Second, the angular distribution of the white light may be especially wide, and even more so compared with the device of Bohler since there is both transmitted and reflected light propagating away from the phosphor toward the viewer.

As a third example, we consider U.S. Pat. No. 7,293,908 B2, titled "Side emitting illumination systems incorporating light emitting diodes", issued on Nov. 13, 2007 to Karl W. Beeson, et al. FIG. 12 from Beeson is reproduced herein as FIG. 3 in the present application.

Light from an LED 702 travels without reflecting off any other optical elements to a wavelength conversion layer (phosphor) 902. A reflector 706 is adjacent to the wavelength conversion layer 902, on the side opposite the LED 702. Wavelength-converted light travels back toward the LED 702, with a lateral component determined by the emission angle distribution of the phosphor 902. The light then reflects off reflector 704, transmits through planar transparent element 802 and exits the device. The reflectors 704 and 706 are planar and parallel, and are longitudinally separated by separation distance 718.

The device of Beeson faces the same two issues as those discussed above for the previous two references. First, the fraction of light leaving the LED 702 that reaches the phosphor 902 may be significantly less than 100%, because of the nature of the free-space propagation between the LED 702 and the phosphor 902 (i.e., light rays may "leak out" of the propagation region and fail to strike the phosphor). Second, the wavelength-converted light that leaves the device has essentially the same angular distribution as the light emitted from the phosphor 902; the reflection off planar mirror 704 does not change the angular distribution of the light. This angular distribution may be too wide for some applications.

For these reasons and others, there exists a need for an LED-based illumination device that has a relatively high efficiency for light propagating from the LED to the phosphor, and has a light output angle distribution that is controllable and/or is narrower than that from the phosphor itself.

BRIEF SUMMARY OF THE INVENTION

An embodiment is an illuminator, comprising: a light-emitting diode module having an LED emission plane for emitting short-wavelength light; a phosphor module longitudinally spaced apart from the light-emitting diode module and including a phosphor layer for absorbing short-wavelength light and emitting wavelength-converted light; an inner reflector circumferentially surrounding the LED emission plane and extending from the LED emission plane to the phosphor module, wherein all the short-wavelength light emitted from the light-emitting diode module either enters the phosphor module directly or enters the phosphor module after a reflection off the inner reflector; and a concave outer reflector circumferentially surrounding the phosphor layer. All the wavelength-converted light emitted from the phosphor module either exits the illuminator directly or exits the illuminator after a reflection off the outer reflector.

Another embodiment is an illuminator, comprising: a light-emitting diode module for producing short-wavelength light and emitting the short-wavelength light into a range of short-wavelength light propagation angles, each short-wavelength light propagation angle being formed with respect to a surface normal at the light-emitting diode module; a phosphor module for absorbing short-wavelength light and emitting phosphor light, the phosphor light having a wavelength spectrum determined in part by a phosphor; wherein the phosphor module receives an inner portion of the short-wavelength light from the light-emitting diode module, the inner portion having a short-wavelength light propagation angle less than a cutoff value; a first reflector for receiving an outer portion of the short-wavelength light, the outer portion having a short-wavelength light propagation angle greater than the cutoff value, and for reflecting the outer portion of the short-wavelength light to the phosphor module; a concave second reflector for receiving the phosphor light and reflecting exiting light, the exiting light having an angular distribution that is narrower than that of the phosphor light.

A further embodiment is a method for producing a narrow, wavelength-converted beam, comprising: emitting short-wavelength light into a short-wavelength angular spectrum from the at least one light-emitting diode, the short-wavelength angular spectrum consisting of a short-wavelength inner angular portion that enters a phosphor module directly, and a short-wavelength outer angular portion that reflects off a first reflector and then enters the phosphor module; absorbing the short-wavelength light at a phosphor layer in the phosphor module; emitting wavelength-converted light from the phosphor layer; exiting the wavelength-converted light into a wavelength-converted angular spectrum from the phosphor module, the wavelength-converted angular spectrum consisting of a wavelength-converted inner angular portion that joins the wavelength-converted beam directly, and a wavelength-converted outer angular portion that reflects off a concave second reflector and then joins the wavelength-converted beam.

DETAILED DESCRIPTION OF THE INVENTION

In many illuminators, light from a short-wavelength light-emitting diode (LED) is transmitted to a phosphor. The phosphor absorbs the short-wavelength light and emits wavelength-converted light, which may have a desired wavelength spectrum that largely depends on the chemistry of the phosphor. For some applications, it may be desirable to increase the efficiency between the LED and the phosphor, so that as much LED light as possible is absorbed by the phosphor. It may also be desirable to narrow the angular distribution of the light emitted by the phosphor, so that the light is narrower than the typical Lambertian distribution, which has a full-width-at-half-maximum (FWHM) of 120 degrees. Note that in some applications, some of the illuminating short-wavelength light may exit the device along with the phosphor-emitted light; in these cases, the total emission spectrum of the device may include a blue contribution from the illuminating LED and a yellow/red contribution from the phosphor.

An illuminator is disclosed, in which an LED module emits short-wavelength light toward a phosphor module, which absorbs the short-wavelength and emits wavelength-conditioned light. The emission is generally longitudinal, with a generally Lambertian distribution about the longitudinal direction. The phosphor module includes a transparent layer, closest to the LED module, and a phosphor layer directly adjacent to the transparent layer. Both layers are oriented generally perpendicular to the longitudinal direction. The illuminator includes a reflector, circumferentially surrounding the emission plane in the LED module and extending longitudinally between the emission plane and the transparent layer. Virtually all the light emitted from the LED module either enters the phosphor module directly, or enters after a reflection off the reflector. The transverse side or sides of the transparent layer support total internal reflection, so that virtually all the light that enters the transparent layer, from the LED module, is transmitted to the phosphor layer. In some applications, the phosphor layer is located at the focus of a concave mirror, which can narrow and/or collimate the light emitted by the phosphor. Adjacent to the phosphor layer and opposite the transparent layer, the phosphor module can include a transparent dome, a heat sink, or nothing.

The above paragraphs are merely a summary, and should not be construed as limiting in any way. More detail is provided in the figures and text that follow.

Figure 4:
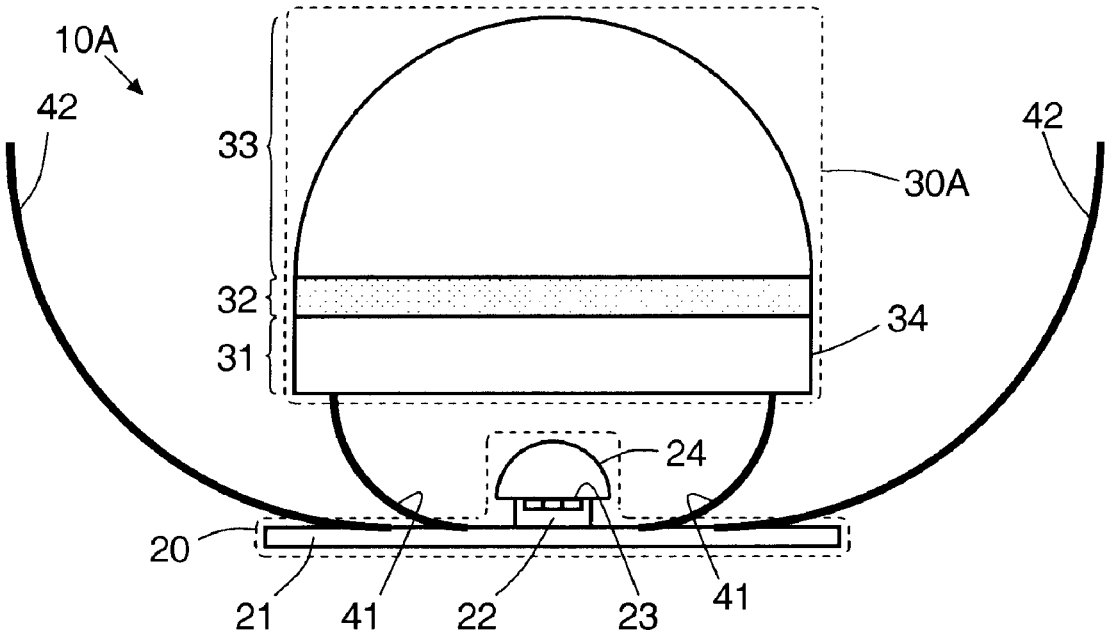
FIG. 4 is a cross-sectional schematic drawing of an exemplary illuminator.

FIG. 4 is a cross-sectional schematic drawing of an exemplary illuminator 10A. The illuminator 10A includes a light-emitting diode module 20 that emits short-wavelength light, a phosphor module 30A that absorbs the short-wavelength light and emits wavelength-conditioned or wavelength-converted light, a first mirror or reflector 41 that circumferentially surrounds the LED module 20 and reflects any transversely-propagating short-wavelength light into the phosphor module 30A, and a second mirror or reflector 42 that directs the wavelength-converted light into a beam that has a desired degree of collimation. Each of these elements is described in further detail below.

The LED module 20 includes a printed circuit board 21, a support platform 22, an emission surface 23, and a lens 24.

The printed circuit board 21 mechanically supports the LEDs and supplies electrical power to the LEDs. The printed circuit board 21 may include its own power supply, such as batteries, or may connect electrically to an external power supply. The printed circuit board 21 may include one or more threaded holes, through-holes, and/or locating features. The printed circuit board 21 may have any suitable shape, such as round, square, rectangular, hexagonal, and so forth.

The support platform 22 is optional, and may include the mechanical and electrical connections required to elevate the LEDs a suitable distance above the actual printed circuit board plane.

The emission surface 23 is the physical location of the light emitting diode plane. It is assumed that all the LEDs in the LED module 20 have their respective outputs emit from the same emission plane 23, although this need not be the case. In this application, the emission plane 23 is drawn as the top-most surface of three horizontally-oriented rectangles, which represent three adjacent LED facets, chips or dies. The LEDs may be arranged in an array, such as a 1 by 2, a 1 by 3, a 2 by 2, a 2 by 3, a 3 by 3, a single LED, or any other suitable number of LED facets. The LED array may be arranged in a rectangular pattern, or any other suitable pattern.

A lens 24 encapsulates the LED array. The lens may encapsulate all the LEDs in the emission plane, as drawn in FIG. 4, or may encapsulate fewer than all the LEDs in the emission plane. Alternatively, the lens 24 may be a series of lenses, each encapsulating its own LED in the emission plane.

In some applications, the lens 24 is hemispherical, with the LED emission plane located at its center. For such a hemispherical lens, the light emerging from the center of the emission plane 23 strikes the entire surface of the hemisphere at roughly normal incidence. For locations on the emission plane 23 other than the center, light may undergo refraction as it exits the lens 24. In general, the lens itself may not be anti-reflection coated, so there may be a reflection loss of about 4% as the light leaves the lens 24. An optional anti-reflection coating may reduce this reflection loss, but may also add to the cost of the device. Note that for sufficiently large emission planes, it is possible for light at the edge of the emission plane to undergo total internal reflection at the curved face of the lens 24, and be effectively stuck inside the lens; this case can generally be avoided by keeping the LED array located sufficiently near the center of the lens 24.

Note also that the lens 24 may have a shape other than hemispherical. For instance, the lens 24 may be bullet-shaped, with optional conic and/or aspheric components to its surface profile.

In general, it is intended that many styles of commercially available packaged LEDs may be used as the LED module 20. For instance, one possible candidate for the LED module 20 is commercially available from OSRAM Opto Semiconductors, and sold under the OSTAR name. Other products from OSRAM Opto Semiconductors and from other manufacturers are available as well, and may equally well be used as the LED module 20.

The LED module 20 radiates short-wavelength light outwardly, with the most power being directed longitudinally away from the LED module, and less power being directed laterally to the sides.

In many cases, the distribution is Lambertian, with a cosine dependence on angle with respect to a surface normal. For instance, if the LEDs completely lacked a lens 24, their bare emission would be generally Lambertian. Lambertian distributions have a characteristic width, usually given as a full-width-at-half-maximum (FWHM) of 120 degrees. This Lambertian distribution is preserved if the lens 24 is hemispherical and the emission plane 23 is located at the center of the hemisphere.

In other cases, the distribution may vary from the Lambertian distribution. For instance, if the emission plane 23 is located longitudinally away from the center of the lens 24, then the short-wavelength light distribution leaving the lens may be narrower or wider than the Lambertian distribution.

The spectrum of the short-wavelength light is determined by the output of LEDs at the emission plane 23. The output from a typical LED is usually centered about a center wavelength, such as 455 nm, with a relatively narrow distribution or width around the center wavelength of up to a few nm or more. The LED emission typically has a much narrower spectrum than the phosphor emission.

In general, the physics of the phosphor-based illumination systems requires that the phosphor absorb light at a particular wavelength or wavelength band and emit light having a longer wavelength; longer wavelengths have less energy than shorter wavelengths. Therefore, for phosphor-based illuminator in which the phosphor can emit light in spectral regions than may cover roughly the full visible spectrum, or about 400 nm to 700 nm in wavelength, the LED may emit light at or near the short end of the visible spectrum. For instance, the LED may emit in the blue portion of the spectrum, around 450 nm, in the violet portion of the spectrum, around 400 nm, or in the ultraviolet (UV) portion of the spectrum, with a wavelength less than about 400 nm.

For a phosphor-based illuminator, it is desirable that the illuminator have a high efficiency between the LED module and the phosphor module. More specifically, it is desirable that the amount of light absorbed by the phosphor, divided by the amount of the leaving the LED, should be as close to 100% as possible.

Figure 1:
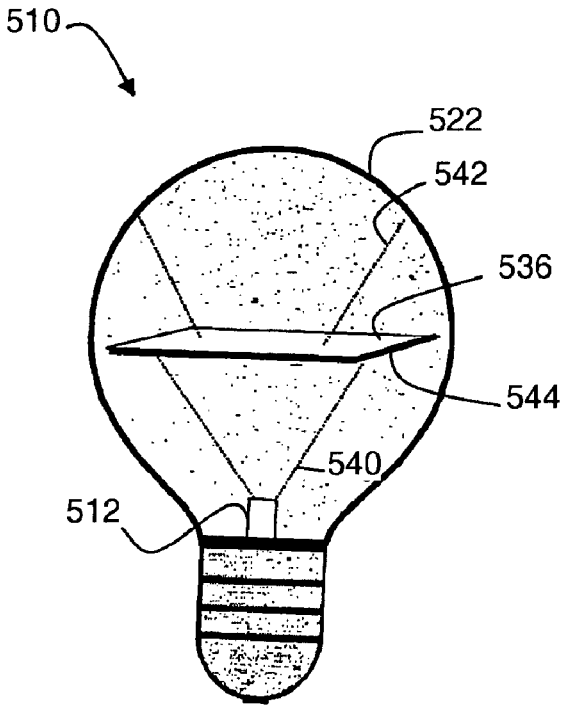
Fig. 1 PRIOR ART
FIG. 1 is a plan drawing of a known lighting system.
Figure 2:
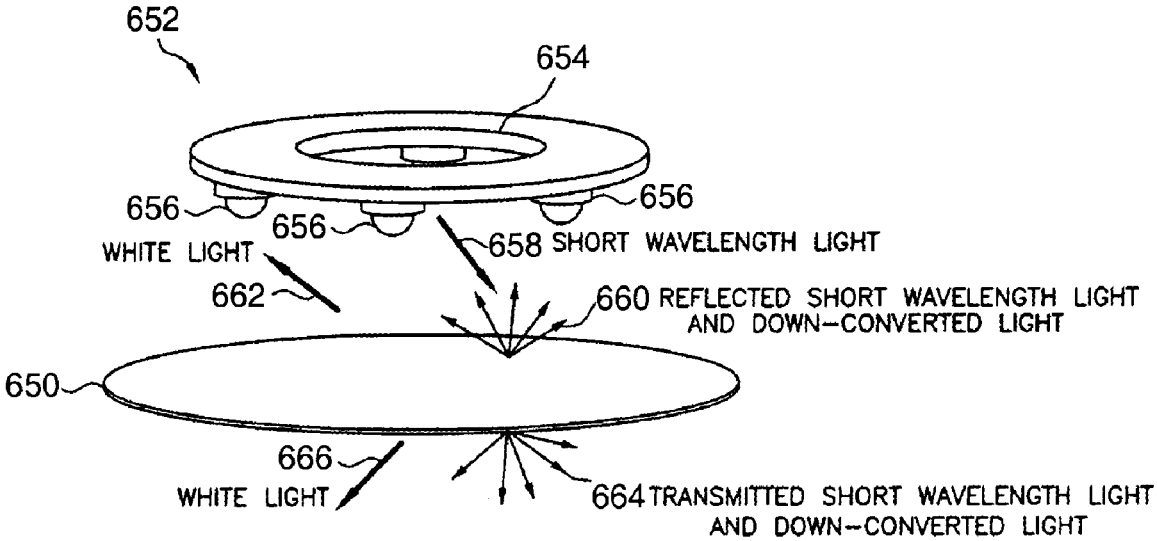
Fig. 2 PRIOR ART
FIG. 2 is a plan drawing of another known lighting system.
Figure 3:
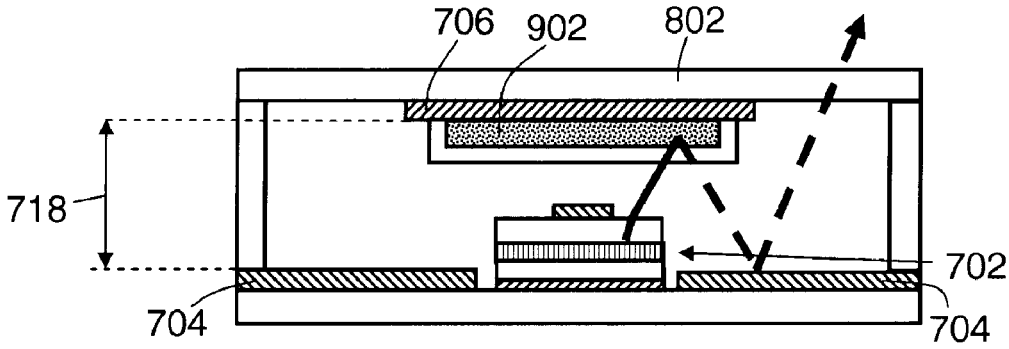
Fig. 3 PRIOR ART
FIG. 3 is a cross-sectional schematic drawing of yet another known lighting system.

For the three known systems shown in FIGS. 1 to 3, the phosphor is longitudinally separated from the LED, and there is nothing to capture the light that propagates away from the LED with a large lateral component. Light emitted laterally to the sides from the LED may miss the phosphor entirely in these systems, and may escape the optical system without being absorbed by the phosphor. Note that each of these three known system may therefore have an inherently low efficiency between the LED emission and the phosphor absorption.

In order to increase the LED-to-phosphor efficiency in the present system, a reflector 41 collects the light that has a substantial lateral propagation component, and reflects it toward the phosphor module. In this manner, light that has a small lateral component may enter the phosphor module 30A directly (as is done with the three known systems of FIG. 1-3), while light with a large lateral component may reflect off the reflector or mirror 41 and then enter the phosphor module 30A.

The phosphor module 30A includes a transparent plate or layer 31, a phosphor or phosphor layer 32, and an optional transparent dome. Each of these elements is described below, after which the geometry of the reflector 41 is discussed.

The transparent layer 31 may be made from any suitable material, such as glass, plastic, acrylic, polycarbonate, silicone, or any other suitable optical material. In general, it is desirable that the transparent layer 31 material have a low absorption, and have a refractive index between about 1.4 and 1.9, although values outside this range may also be used. The transparent layer 31 may be relatively thick, having a thickness of up to several mm or more.

In some cases, the transparent layer 31 has a lateral edge, or several lateral edges, than can support total internal reflection. In general, it is desirable that the short-wavelength light from the LED undergoes total internal reflection at the lateral edge, because such a reflection is generally lossless for smooth lateral surfaces. If the lateral surfaces are roughened to induce scattering, some of the reflected LED light may be lost to scattering.

The phosphor layer 32 may be relatively thin, compared to the transparent layer 31, with a typical thickness of 0.5 mm or less. As stated above, the phosphor absorbs light at the relatively short wavelength emitted by the LED module 20, and emits relatively long wavelength light. The specific spectral characteristics of the phosphor emission depend largely on the chemistry of the phosphor 32. While such spectral characteristics may be very important for the perceived color of the phosphor, they are relatively unimportant here. In general, it is sufficient to say that the phosphor layer 32 absorbs relatively short-wavelength light, typically in the blue, violet and/or UV spectral regions, and emits relatively long-wavelength light, typically spanning all or a portion of the visible spectrum, which includes violet to red spectral regions. Many phosphors are known, and as research in the field of phosphors continues, any or all of the present and future phosphors may be used with the device herein.

In some cases, the phosphor layer 32 may be made as follows. The phosphor itself may be a ceramic powder, which is mixed into a silicone liquid, applied to a face of the transparent layer 31, and cured. In this manner, the phosphor layer 32 is integral with a relatively rugged transparent layer 31, which may simplify handling of the phosphor and may improve the durability of the phosphor during use.

The exemplary phosphor module 30A includes an optional transparent dome 33, adjacent to the phosphor layer 32 on the side opposite the transparent layer 31. The transparent dome 33 may be similar in function, construction and materials to the lens 24 of the LED module 20; its effect on the light emitted from the phosphor is discussed in connection with FIG. 9 below.

We now discuss the geometry of the illuminator elements.

Figure 5:
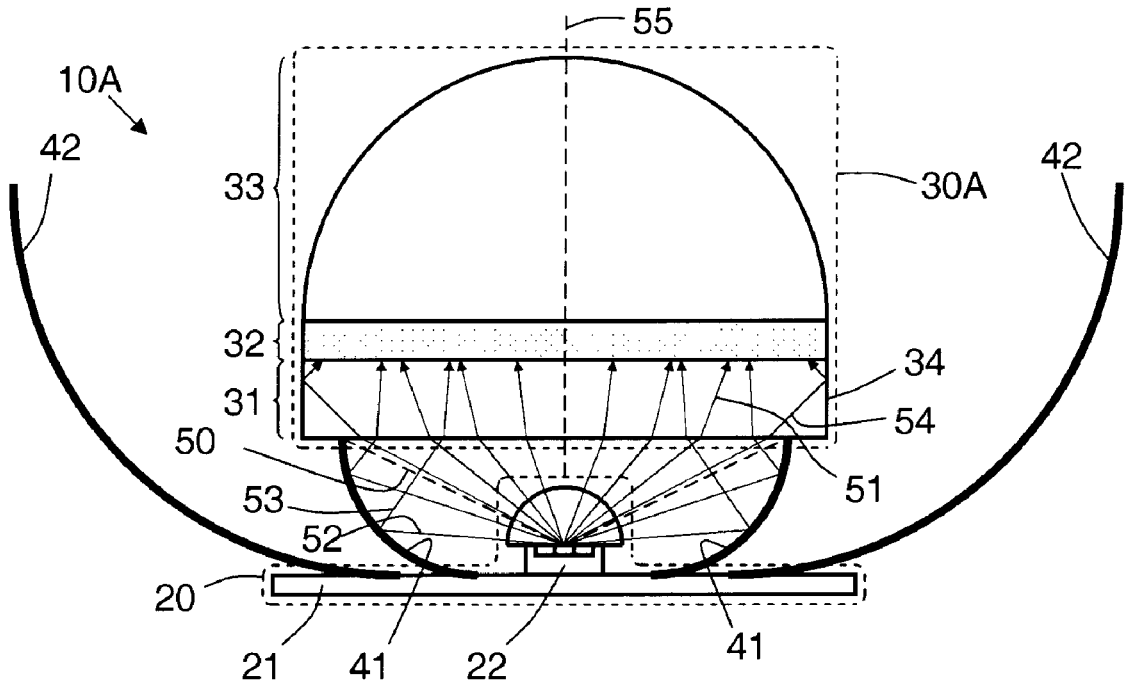
FIG. 5 is a cross-sectional schematic drawing of the illuminator of FIG. 4, with additional light rays being shown from the LED module to the phosphor module.

FIG. 5 is a cross-sectional schematic drawing of the illuminator 10A of FIG. 4, with additional light rays being shown from the LED module 20 to the phosphor module 30A. Rays 51 having a relatively small lateral propagation component enter the phosphor module 30A directly, while rays 52 having a larger lateral propagation component first reflect off reflector 41 before entering the phosphor module 30A. Note that unlike the three known systems of FIG. 1-3, there are no short-wavelength light rays that exit the illuminator laterally through the space between the LED and the phosphor.

In some cases, the reflector 41 may circumferentially surround the LED emission plane 23, to reduce or minimize the "leakage" around the side of the reflector 41. In some cases, the reflector 41 may extend from the LED emission plane 23 all the way to the phosphor module 30A, and may contact the surface of the phosphor module 30A. This, too, may reduce or minimize undesirable "leakage" of the LED light. For reflectors having such a geometry, one may define a particular threshold angle 50 with respect to the surface normal 55. Rays 51 with a propagation angle (with respect to the surface normal 55) less than the threshold angle 50 enter the phosphor module 30A directly, and rays 52 with a propagation angle greater than the threshold angle 50 reflect off the reflector 41, and become redirected rays 53 that then enter the phosphor module 30A.

The shape of the reflector 41 itself causes two notable effects. First, the rays reflected off the reflector 41 change direction. Upon reaching the phosphor, these rays are assumed to all be absorbed, and the absorption is assumed to be independent of propagation angle. We assume that a longitudinally propagating ray is absorbed the same as a ray that has a significant lateral propagation component. As a result, the change in direction of the rays is not terribly important.

The second effect, more significant than the change in propagation angle, is that the reflector 41 can change the actual location on the phosphor at which particular rays arrive. For instance, note that in the exemplary illuminator 10A of FIG. 5, the rays 53 that reflect off the reflector 41 are directed not to the center of the phosphor, but to an intermediate region between the center and the edge of the phosphor. As such, the reflector 41 may help avoid so-called "hot spots" in the phosphor layer 32 by redistributing the light incident on the phosphor layer 32.

In some cases, the reflector 41 may be concave in cross-section, as is drawn in FIGS. 4 and 5. In some of those cases, the reflector 41 may be parabolic in cross-section. In other cases, the reflector 41 may be linear in cross-section, and may appear in three dimensions as a section of a cone. In still other cases, the reflector 41 may be convex in cross-section. In yet other cases, the reflector 41 may include concave and flat portions, convex and flat portions, and/or concave and convex portions.

Figure 6:
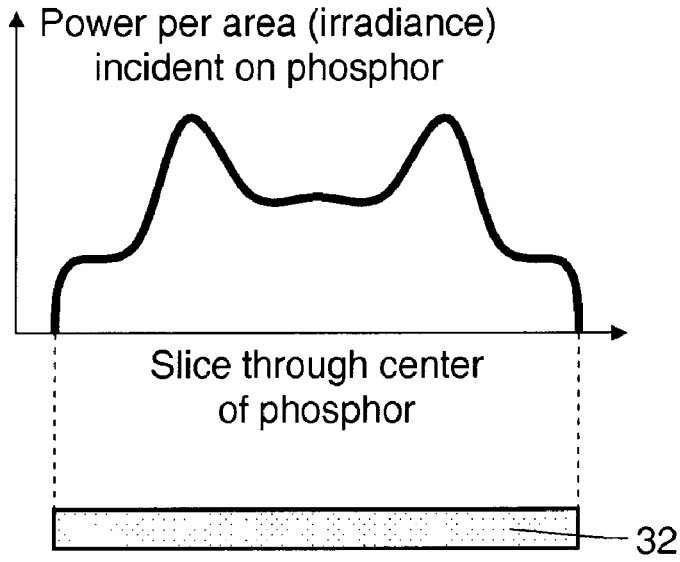
FIG. 6 is a plot of power per area incident on the phosphor layer.

FIG. 6 is an exemplary plot of power per area (known in the field as "irradiance") incident on the phosphor layer 32, taken as a cross-sectional slice through the center of the phosphor layer 32. We see that the power per area does not peak at the center, but has relatively small peaks on either side of the center. In this example the peaks may correspond to the light that reflects off reflector 41; note the arrival location at the phosphor layer 32 of rays 53 in FIG. 5.

In many cases, it is desirable to avoid having a sharply-peaked distribution of power per area (irradiance) at the phosphor layer; such a peaked distribution may lead to thermal problems, in which heat at peaked locations is not adequately dissipated. In some cases, it is desirable to make the power per area (irradiance) at the phosphor layer 32 as uniform as possible.

Note that from an optical point of view, it is desirable to have all the light strike the center of the phosphor layer. The angular spread of the beam that exits the illuminator 10A depends on the size of the phosphor that absorbs and emits light. A relatively big phosphor 32, which absorbs and emits light over a relatively large area, may have a larger angular divergence in its exiting beam than a relatively small phosphor 32 or a phosphor that absorbs and emits light only over a relatively small area. In practice, there is a trade-off between optical performance, which drives toward a sharply-peaked distribution in FIG. 6, and thermal performance, which drives toward a uniform distribution in FIG. 6.

The previous discussion of FIG. 4 to 6 describe the optical path from the LED to the phosphor, where ultimately the phosphor absorbs the short-wavelength LED light. We now turn to the emission of light from the phosphor, shown in FIGS. 7 to 9 and described in the text that follows.

Figure 7:
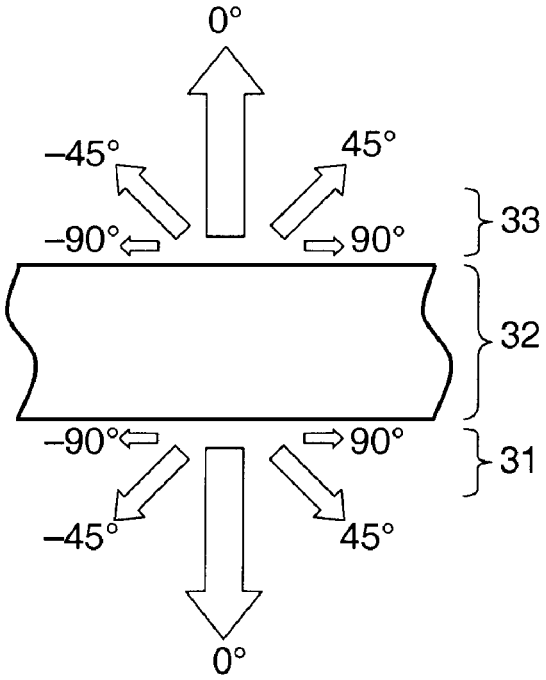
FIG. 7 is a cross-sectional schematic drawing of a portion of the phosphor layer, with the transparent layer below and the transparent dome above the phosphor layer.

FIG. 7 is a cross-sectional schematic drawing of a portion of the phosphor layer 32, with the transparent layer 31 drawn below and the transparent dome 33 drawn above the phosphor layer 32. The size of the arrows indicates the relative strength of the emission in the corresponding direction.

We see that the phosphor layer 32 emits light from both of its sides, even though the illumination with short-wavelength light may only be from one side. We also see that the emission pattern of the phosphor layer 32 may be independent of the angles at which the short-wavelength light strikes the phosphor layer 32. In general, these two statements are true for most or all phosphors, regardless of the spectral characteristics of the phosphor emission.

Figure 8:
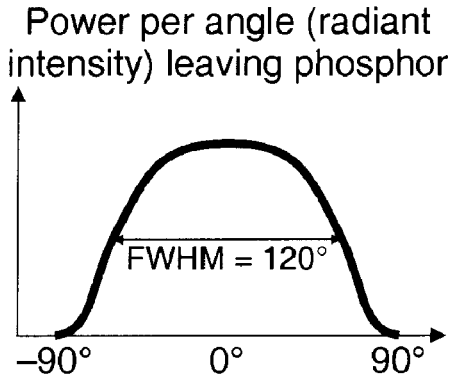
FIG. 8 is a plot of a Lambertian distribution of emitted power per angle.

The phosphor layer 32 emits wavelength-converted light, in both directions, with a Lambertian distribution. The Lambertian distribution peaks angularly with a surface normal (drawn at 0 degrees), and falls off angularly with a cosine dependence (with respect to the surface normal). At 90 degrees, the distribution goes to zero. The characteristic width of this Lambertian distribution is given by a full-width-at-half-maximum (FWHM) of 120 degrees, as shown in FIG. 8.

Note that this FWHM of 120 degrees describes the known illuminator of FIG. 3, in which a flat mirror 704 reflects the light emitted "downward" to the "upward" side. The "upward" peak increases by a factor of two, but so does the half-peak, so that FWHM of the beam output in FIG. 3 is 120 degrees.

In FIGS. 1 and 2, the wavelength-converted light is emitted in both "up" and "down" directions, so that its emission pattern is bi-modal, with 120-degree-wide peaks both "up" and "down". This is basically the emission pattern shown in FIG. 7, with output beams going both "up" and "down". Such an emission pattern may be suitable for incandescent bulb replacements, but for the narrow beam applications described herein, such an emission pattern is far too wide.

Having described the emission pattern of the light emitted by the phosphor layer 32 as a Lambertian distribution, in both "up" and "down" directions, and stating that such a Lambertian distribution may be too wide for use in our narrow-beam illuminator 10A, we now proceed to describe the effects that narrow the light emitted by the phosphor layer 32. We turn to FIG. 9, which is a cross-sectional schematic drawing of the illuminator 10A of FIGS. 4 and 5, with additional light rays being shown exiting the phosphor module 30A.

Figure 9:
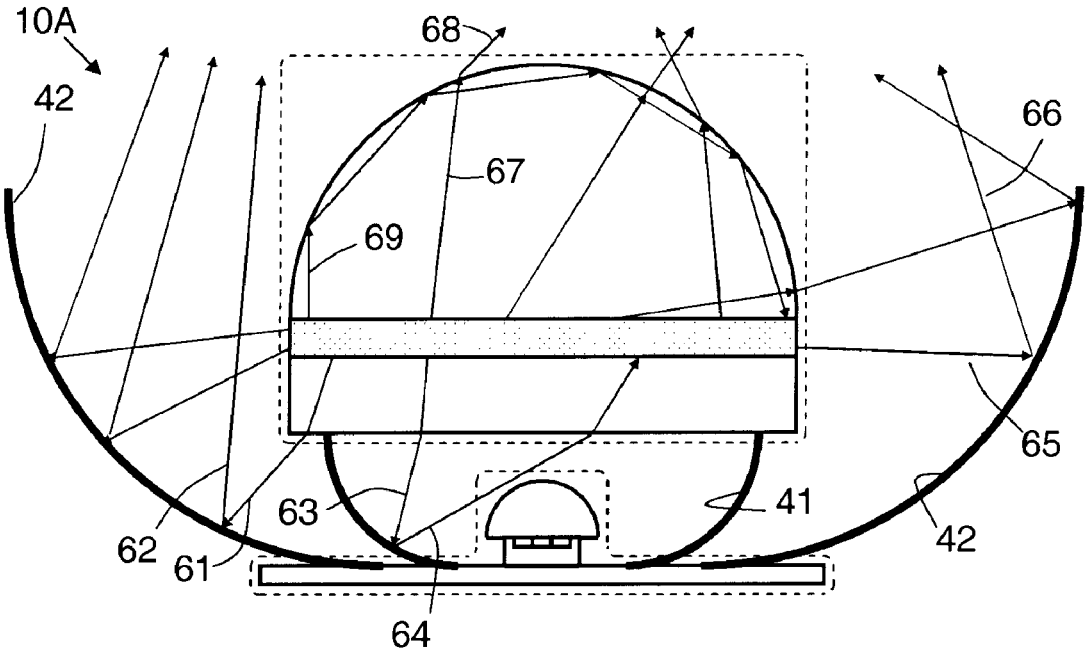
FIG. 9 is a cross-sectional schematic drawing of the illuminator of FIGS. 4 and 5, with additional light rays being shown exiting the phosphor module.

Light from the phosphor module 30A either exits the illuminator 10A directly (to the top of FIG. 9) or first strikes a second reflector 42 and then exits the illuminator 10A (also to the top of FIG. 9). As with the first reflector 41, also referred to as the "inner" reflector, the second or "outer" reflector 42 may also be any combination of concave, convex or flat in cross-section.

In some cases, the outer reflector 42 may be parabolic in cross-section, with the phosphor layer 32 located at the focus of the parabola. The outer reflector 42 is then a parabolic mirror, which collimates the light leaving the phosphor layer 32.

We treat the various cases for phosphor emission by examining the various emitted rays in FIG. 9.

Ray 61 is emitted from the phosphor layer 32 into the transparent layer 31, and exits the bottom surface of the transparent layer 31. The ray 61 then reflects off a second reflector 42, which directs the reflected ray 62 out of the illuminator 10A. These rays 61 and 62 are well-controlled by the mirror 42, in that the exiting direction of ray 62 may be controlled to within a particular range by the shape of the mirror 42. For a parabolic mirror 42, the exiting directions may all lie within a particular angular range, generally centered about a longitudinal axis. Note also that there may be more of these rays 61 and 62 if there is a significant overhang of the transparent layer 31, radially beyond that of the inner mirror 41. It is desirable that the transparent layer 31 and phosphor layer 32 both extend radially beyond the inner reflector 41, over the entire circumference of the inner reflector 41.

Ray 61 may undergo a small reflection of about 4% on the bottom surface of the transparent layer 31. This small reflection may be reduced by applying an anti-reflection coating to the transparent layer 31, with the trade-off of the device costing a bit more.

Ray 63 is also emitted from the phosphor layer 32 into the transparent layer 31, but exits the bottom surface of the transparent layer 31 into the area circumscribed by the inner reflector 41. If the inner reflector 41 shape is chosen carefully, then the majority of these rays 63 are reflected by the inner reflector 41 and produce reflected rays 64 that re-enter the transparent layer 31 and phosphor layer 32, and are "recycled" with a low power loss.

Ray 65 is emitted from a lateral side of the phosphor layer 32, and reflects off the outer mirror 42 to become reflected ray 66 that exits the illuminator 10A. As with rays 61 and 62, the angular range into which ray 66 propagates may be controlled by the shape of the mirror 42.

Ray 67 is emitted upward from the phosphor layer, into the transparent dome 33. Ray 67 undergoes refraction at the curved surface of the dome 33, and exits the illuminator as ray 68. If the mirror 42 extends longitudinally far enough, it may receive ray 68 and give it a reflection before it leaves the illuminator 10A. As with the transparent plate, the dome 33 may optionally have an anti-reflection coating, which would reduce reflection loss at the expense of increasing the cost of the device.

Ray 69 exits the phosphor layer fairly close to the lateral edge of the dome 33, and undergoes multiple internal reflections inside the dome. Ray 69 ultimately re-enters the phosphor layer 32 and is "recycled" with a low power loss. Note that this total internal reflection occurs for the dome 33, because the phosphor layer 32 laterally extends all the way across the dome. Such a total internal reflection does not occur for the lens 24 in the LED module, because the LED chips are relatively close to the center of the lens 24 and do not extend laterally all the way across the lens 24.

Given the variety of exiting conditions for the various emitted rays 61-69 and their relationship to the outer reflector 42, it is not surprising that the emission pattern of the illuminator 10A may be rather complicated. We may simplify the emission pattern somewhat by breaking it down into its two primary contributions: total emission pattern from illuminator 10A=emission pattern leaving directly+emission pattern reflected off reflector 42.

The emission pattern leaving the illuminator 10A directly may be close to Lambertian in profile. If all the light leaving the phosphor layer originated at the center of the dome, it would be Lambertian. However, the light actually leaves the phosphor over an extended lateral area, which complicates the emission pattern slightly. We may therefore refer to it as "roughly" Lambertian, with the caveat that the true pattern is complicated by the extended phosphor area.

The emission pattern reflected off the mirror 42 may be significantly narrower than a Lambertian distribution. If the mirror 42 is a paraboloid, with a parabolic cross-section, then it may collimate the light emitted from the phosphor. Such a collimated beam may be significantly narrower than the approximately 120 degree FWHM of the "roughly" Lambertian light.

Figure 10:
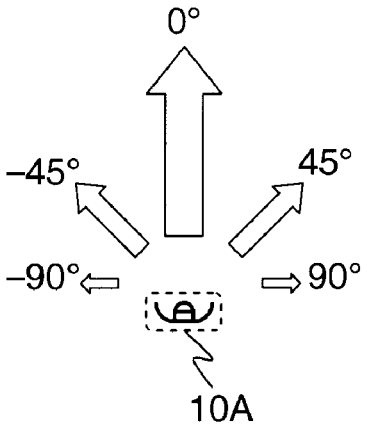
FIG. 10 is a schematic drawing of the angular distribution of power exiting the illuminator.
Figure 11:
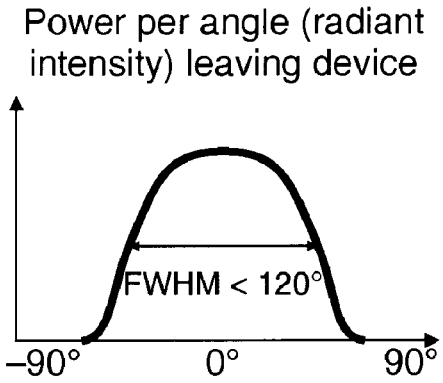
FIG. 11 is a plot of power per angle exiting the illuminator.

The true emission pattern is the summed average of the above-described narrow beam with the "roughly" Lambertian beam. Such an emission pattern may have a FWHM that falls between the "few degrees" of the collimated beam and the roughly 120 degrees of the "roughly" collimated beam. This is shown schematically in FIGS. 10 and 11, which show the angular output of illuminator 10A, and the power per angle (referred to as "radiant intensity") distribution with respect to exiting angle.

Figure 12:
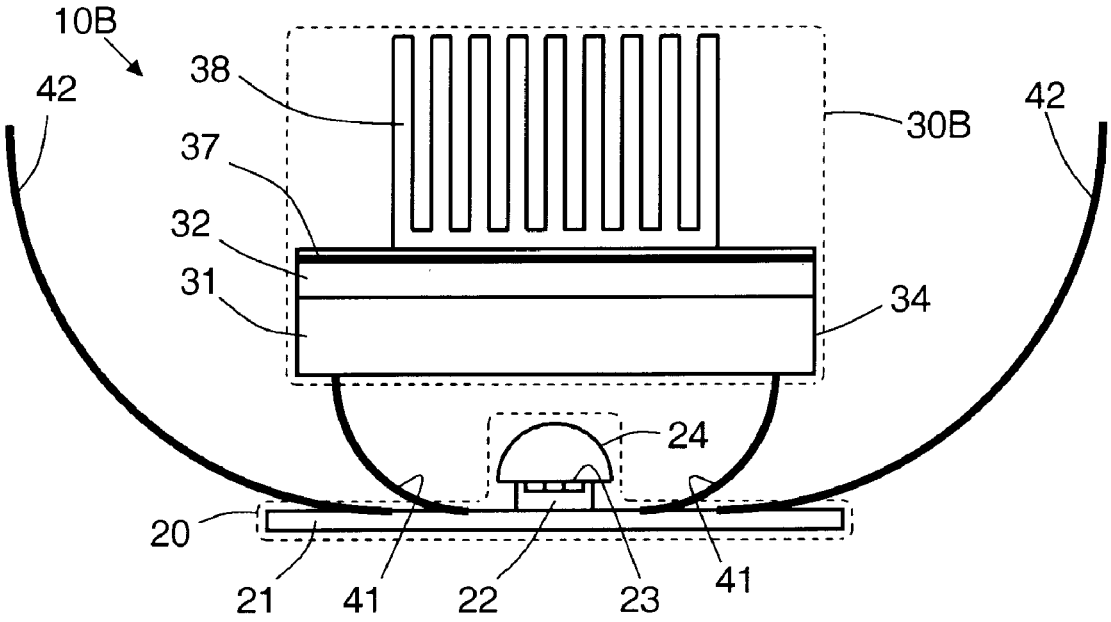
FIG. 12 is a cross-sectional schematic drawing of an exemplary illuminator with a phosphor-mounted heat sink.
Figure 13:
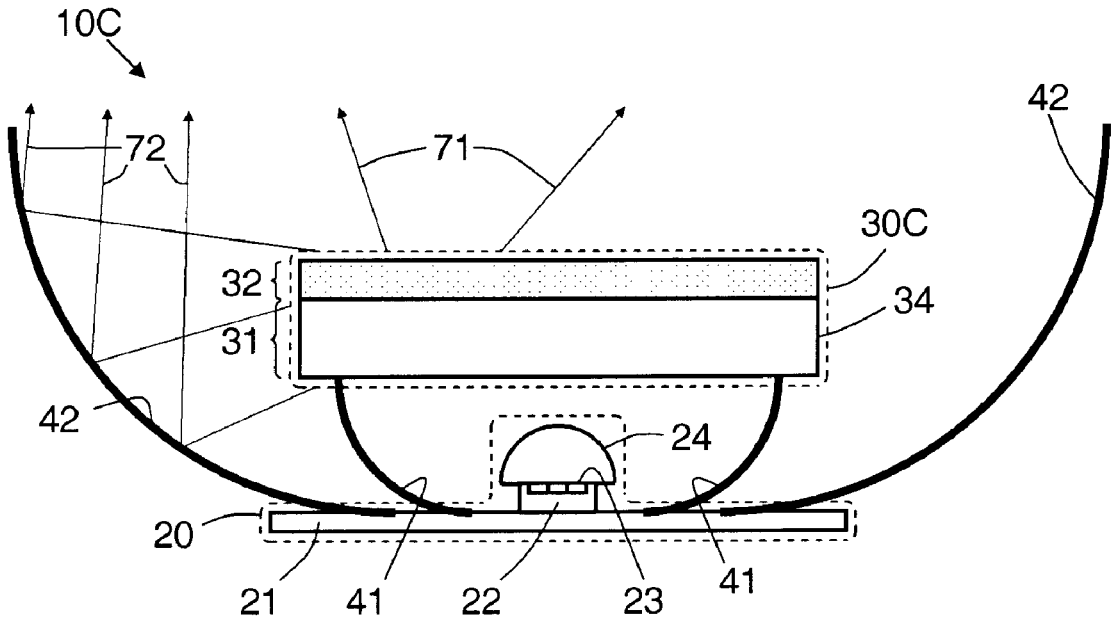
FIG. 13 is a cross-sectional schematic drawing of an exemplary illuminator, in which the transparent dome in the phosphor module is omitted.
Figure 14:
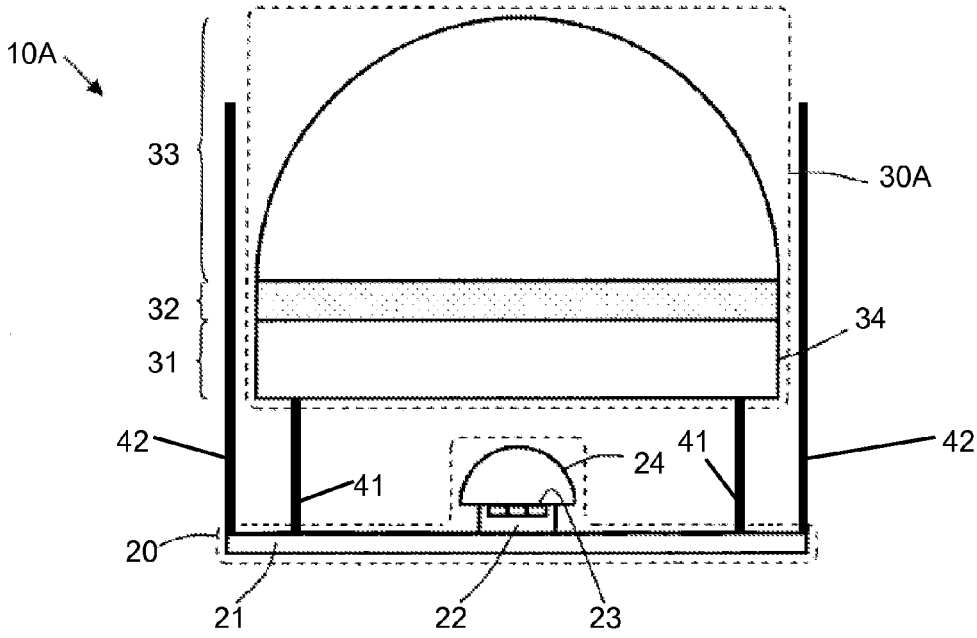
FIG. 14 is a cross-sectional schematic drawing of an exemplary illuminator with a cylindrical-shaped inner reflector and outer reflector.

There are other options for the phosphor module 30A, which are shown in FIGS. 12 and 13, and are described below.

There may be instances when the phosphor layer 32 generates a lot of heat and may require an external element to dissipate the heat. FIG. 12 shows an illuminator 10B in which the phosphor module 30B includes a heat sink 38 for dissipating the heat from the phosphor layer 32. Because the heat sink 38 blocks the optical path "upward", the phosphor module 30B also includes a reflecting layer 37 that "recycles" downward any light that is emitted upward from the phosphor layer 32. In some cases, the efficiency of such a phosphor module 30B is reduced, when compared with a phosphor module in which the light is allowed to exit in both "upward" and "downward" directions.

FIG. 13 is a cross-sectional schematic drawing of an exemplary illuminator 10C, in which the transparent dome in the phosphor module 30C is omitted. The light that leaves the phosphor module 30C may include rays that exit the illuminator 10C directly, and rays 72 that first reflect off the outer reflector 42 before leaving the illuminator 10C. The output angular distribution of this illuminator 10C is similar to that of illuminator 10A.

The discussion thus far has involved the structure of illuminators 10A, 10B and 10C. The following paragraphs are directed toward various simulation results for illuminator 10A. The simulations were performed using LightTools, which is a raytracing computer program commercially available from Optical Research Associates in Pasadena, Calif. Alternatively, other raytracing programs may be used, such as TracePro, Zemax, Oslo, Code V, as well as homemade raytracing routines in Matlab, Excel, or any other suitable calculation tools.

A raytrace simulation was run for the system shown schematically in FIG. 4, with the intent of calculating the irradiance (power per area) across a slice of the phosphor.

Dimensions and system parameters were set as follows. The light source was a 3 mm by 3 mm LED chip array, with a wavelength of 450 nm, a total output power of 1 watt, a square chip area, and a Lambertian angular distribution (i.e., a cosine falloff in power per angle, with respect to the surface normal). The chip area was encapsulated in a hemisphere made of silicone, with a refractive index of 1.5 at 450 nm. The hemisphere had a diameter of 6.4 mm, with the center of the square chip area being at the center of the hemisphere. The chip array was longitudinally spaced 3.2 mm away from the transparent plate. A reflector having a power reflectivity of 90% extended from the chip array, where the reflector had a diameter of 6.4 mm, to the transparent plate, where the reflector had a diameter of 11.1 mm. The reflector shape was parabolic, with a focus at the chip array. The rectangular transparent plate was made of BK7 glass, with a refractive index of 1.5 at 450 nm. The transparent plate had a longitudinal thickness of 10 mm, and top surface dimensions of 20 mm by 20 mm. The transverse edge of the plate was polished, and supported total internal reflection. The face of the plate facing the LED array had an anti-reflection coating of a quarter-wave of $MgF_2$ at 450 nm, with a refractive index of 1.39 at 450 nm and a real longitudinal thickness of 112 nm.

The results of the raytrace simulation showed that 96.7% of the LED rays reached the phosphor, with the 3.3% loss arising mainly from reflection off the mirror (R=90%). The peak intensity was 5.4 watts per $cm^2$, with its peak being located away from the center of the phosphor. The intensity across a radial slice of the phosphor closely resembled the curve shown in FIG. 6.

Given that the LED-to-phosphor optical path performed satisfactorily, a second raytracing simulation was performed to model the phosphor emission.

For this simulation, the emission from the phosphor was assumed to be Lambertian, with a constant emitted power per area over the entire phosphor surface, with equal emissions in both top and bottom directions, and no scatter. The spectral characteristics of the phosphor were neglected for this particular simulation, and the refractive indices of the optical elements were assumed to be invariant with wavelength. The "bottom" direction used the elements from the previous simulation, with the phosphor having essentially zero thickness and being located on the top surface of the transparent plate. The "top" direction included a partial transparent sphere extending from the phosphor upward, the phosphor being located close to, but not necessarily at, the center of the partial sphere. The partial sphere was made of glass, with a refractive index of 1.5 at all wavelengths. The useful output quantity from this calculation was a fraction of rays that exit the system. More precisely, the fraction was defined as the number of rays exiting the optical system, divided by the number of rays originating at the phosphor. It is assumed that if a ray exits the system, then it will either pass directly out of the illuminator or will first reflect off the outer reflector (not simulated) and then pass out of the illuminator.

There were three successive simulations performed for this phosphor emission modeling. First, the partial sphere was omitted, leaving the top side of the phosphor exposed to the exiting direction of the illuminator. For this "no optic" case, it was found that 80.5% of the rays escape the system. Second, the partial sphere had a diameter of 28.3 mm, with an on-axis separation between the top of the sphere and the LED array of 29 mm. For this 28.3 mm diameter optic case, it was found that 91.9% of the rays escape the system. Third, the partial sphere had a diameter of 42.5 mm, with an on-axis separation between the top of the sphere and the LED array of 36 mm. For this 42.5 mm diameter optic case, it was found that 93.2% of the rays escape the system. This value of about 93% was deemed sufficient.

The loss, or percentage of rays that do not exit the system, arises from total internal reflection loss, analogous to ray 69 in FIG. 9, and loss at the parabolic (inner) reflector. In practice, the loss may be less for a device having a real phosphor.

The package efficiency was given by the value of 96.7% times 93%, or about 90%, excluding the outer reflector. If the outer reflector is included in the simulation, the efficiency drops to about 84%. In addition, the simulated beam angle with the reflector was about 30 degrees FWHM, which is much narrower than the Lambertian 120 degree FWHM.

The above simulations were performed on an exemplary configuration and set of dimensions, and should not be construed as limiting in any way.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

I claim:

1. An illuminator (10A, 10B, 10C), comprising:

a light-emitting diode module (20) having an LED emission plane (23) for emitting short-wavelength light;

a phosphor module (30A, 30B, 30C) longitudinally spaced apart from the light-emitting diode module (20) and including a phosphor layer (32) for absorbing short-wavelength light and emitting wavelength-converted light, wherein the phosphor module (30A, 30B, 30C) further comprises a generally planar transparent layer (31) parallel and longitudinally directly adjacent to the phosphor layer (32) and facing the light-emitting diode module (20), and wherein the transparent layer (31) includes a lateral edge (34) that supports total internal reflection;

an inner reflector (41) circumferentially surrounding the LED emission plane (23) and extending from the LED emission plane (23) to the phosphor module (30A, 30B, 30C), wherein all the short-wavelength light emitted from the light-emitting diode module (20) either enters the phosphor module (30A, 30B, 30C) directly or enters the phosphor module (30A, 30B, 30C) after a reflection off the inner reflector (41), and wherein the inner reflector (41) contacts the transparent layer (31) continuously around a circumference of the inner reflector (41); and a concave outer reflector (42) circumferentially surrounding the phosphor layer (32), wherein all the wavelength-converted light emitted from the phosphor module (30A, 30B, 30C) either exits the illuminator (10A, 10B, 10C) directly (71) or exits the illuminator (10A, 10B, 10C) after a reflection off the outer reflector (42) (72);

wherein the transparent layer (31) contacts only a single inner reflector (41) and only a single concave outer reflector (42), and wherein the phosphor layer (32) and transparent layer (31) both extend outward beyond the inner reflector (41), over the entire circumference of the inner reflector (41), such that virtually all the short-wavelength light emitting from the light-emitting diode module (20) that enters the transparent layer (31) is transmitted to the phosphor layer (32) due to total internal reflection within the transparent layer (31).

2. The illuminator (10A, 10C) of claim 1, wherein the inner reflector (41) and the outer reflector (42) are cylindrical and coaxial.

3. The illuminator (10A, 10C) of claim 1, wherein the phosphor module (30A, 10C) is rectangular and is coaxial with both the inner reflector (41) and the outer reflector (42).

4. The illuminator (10A) of claim 1, wherein the phosphor module (30A) further comprises a transparent dome (33) longitudinally directly adjacent to the phosphor layer (32) and facing away from the light-emitting diode module (20).

5. The illuminator (10A) of claim 4, wherein the transparent dome (33) includes a curved portion comprising a hemisphere.

6. The illuminator (10A) of claim 4, wherein the transparent dome (33) is made from a transparent material having a refractive index between 1.4 and 1.9.

7. The illuminator (10B) of claim 1, wherein the phosphor module (30B) further comprises:

a reflective layer (37) directly adjacent to the phosphor layer (32) and facing away from the light-emitting diode module (20); and a heat sink (38) directly adjacent to the reflective layer (37) and facing away from the light-emitting diode module (20).

8. The illuminator (10C) of claim 1, wherein the phosphor layer (32) forms a longitudinal edge of the phosphor module (30C).

9. The illuminator (10A, 10B, 10C) of claim 1, wherein the inner reflector (41) is concave.

10. The illuminator (10A, 10B, 10C) of claim 1, wherein all the short-wavelength light that enters the phosphor module (30A, 30B, 30C) forms a power-per-area distribution at the phosphor layer (32) that peaks away from the center of the phosphor layer (32).

11. The illuminator (10A, 10B, 10C) of claim 1, wherein the outer reflector (42) is parabolic in a cross-section that includes its longitudinal axis (55); and wherein the outer reflector (42) has a focus coincident with the phosphor layer (32).

12. The illuminator (10A, 10B, 10C) of claim 1, wherein the wavelength-converted light emitted from the phosphor layer (32) has a Lambertian distribution with a full-width-at-half-maximum value of 120 degrees.

13. The illuminator (10A, 10B, 10C) of claim 1, wherein the wavelength-converted light exiting the illuminator (10A, 10B, 10C) has a full-width-at-half-maximum value of less than 120 degrees.

14. The illuminator (10A, 10B, 10C) of claim 1, wherein the planar transparent layer (31) is made from a material having a refractive index between 1.4 and 1.9.

15. The illuminator (10A, 10B, 10C) of claim 1, wherein the phosphor layer (32) is formed from a ceramic powder, mixed in silicone liquid, applied to the planar transparent layer (31), and cured.

16. An illuminator (10A, 10B, 10C), comprising:

a light-emitting diode module (20) for producing short-wavelength light and emitting the short-wavelength light into a range of short-wavelength light propagation angles, each short-wavelength light propagation angle being formed with respect to a surface normal (55) at the light-emitting diode module (20);

a phosphor module (30A, 30B, 30C) for absorbing short-wavelength light (51, 53) and emitting phosphor light (61, 65), the phosphor light (61, 65) having a wavelength spectrum determined in part by a phosphor (32), wherein the phosphor module (30A, 30B, 30C) further comprises a generally planar transparent layer (31) parallel and longitudinally directly adjacent to the phosphor layer (32) and facing the light-emitting diode module (20), and wherein the transparent layer (31) includes a lateral edge (34) that supports total internal reflection;

wherein the phosphor module (30A, 30B, 30C) receives an inner portion (51) of the short-wavelength light from the light-emitting diode module (20), the inner portion (51) having a short-wavelength light propagation angle less than a cutoff value (50);

a first reflector (41) for receiving an outer portion (52) of the short-wavelength light, the outer portion (52) having a short-wavelength light propagation angle greater than the cutoff value (50), and for reflecting the outer portion (53) of the short-wavelength light to the phosphor module (30A, 30B, 30C), and wherein the first reflector (41) contacts the transparent layer (31) continuously around a circumference of the first reflector (41);

a concave second reflector (42) for receiving the phosphor light (61, 65) and reflecting exiting light (62, 66), the exiting light (62, 66) having an angular distribution that is narrower than that of the phosphor light (61, 65);

wherein the transparent layer (31) contacts only a single inner reflector (41) and only a single concave outer reflector (42), and wherein the phosphor layer (32) and transparent layer (31) both extend outward beyond the first reflector (41), over the entire circumference of the first reflector (41), such that virtually all the short-wavelength light emitting from the light-emitting diode module (20) that enters the transparent layer (31) is transmitted to the phosphor layer (32) due to total internal reflection within the transparent layer (31).

17. A method for producing a narrow, wavelength-converted beam, comprising:

emitting short-wavelength light into a short-wavelength angular spectrum from at least one light-emitting diode, the short-wavelength angular spectrum consisting of a short-wavelength inner angular portion that enters a phosphor module (30A, 30B, 30C) directly, and a short-wavelength outer angular portion that reflects off a first reflector (41) and then enters the phosphor module (30A, 30B, 30C), wherein the phosphor module (30A, 30B, 30C) further comprises a generally planar transparent layer (31) parallel and longitudinally directly adjacent to the phosphor layer (32) and facing the light-emitting diode, and wherein the transparent layer (31) includes a lateral edge (34) that supports total internal reflection, and wherein the inner reflector (41) contacts the transparent layer (31) continuously around a circumference of the inner reflector (41), and wherein the transparent layer (31) contacts only a single inner reflector (41) and only a single concave outer reflector (42), and wherein the phosphor layer (32) and transparent layer (31) both extend outward beyond the inner reflector (41), over the entire circumference of the inner reflector (41);

absorbing the short-wavelength light at a phosphor layer (32) in the phosphor module (30A, 30B, 30C) via total internal reflection within the transparent layer (31), such that virtually all light emitted from the light-emitting diode is transmitted to the phosphor layer (32) via the transparent layer (31);

emitting wavelength-converted light from the phosphor layer (32); and exiting the wavelength-converted light into a wavelength-converted angular spectrum from the phosphor module (30A, 30B, 30C), the wavelength-converted angular spectrum consisting of a wavelength-converted inner angular portion that joins the wavelength-converted beam directly, and a wavelength-converted outer angular portion that reflects off a concave second reflector (42) and then joins the wavelength-converted beam.

* * * * *